United States Patent [19]

Johnson et al.

[11] Patent Number: 4,702,147

[45] Date of Patent: Oct. 27, 1987

[54] ENGINE WITH PNEUMATIC VALVE ACTUATION

[76] Inventors: Don E. Johnson; D. Scott Johnson, both of 256 North Fraser Dr. West, Mesa, Ariz. 85203

[21] Appl. No.: 762,244

[22] Filed: Aug. 2, 1985

[51] Int. Cl.[4] ..... F01L 25/02

[52] U.S. Cl. ..... 91/318; 91/303; 91/323; 91/351; 92/137

[58] Field of Search ..... 91/317, 318, 319, 323, 91/409, 303, 351; 92/137

[56] References Cited

U.S. PATENT DOCUMENTS

| | | | |
|---|---|---|---|
| 209,323 | 10/1878 | Bishop . | |
| 588,062 | 8/1892 | Hart . | |
| 619,867 | 2/1999 | Cook . | |
| 623,149 | 4/1899 | Hart . | |
| 731,664 | 6/1903 | Clark . | |
| 740,089 | 9/1903 | Clark . | |
| 840,394 | 1/1907 | Stollar . | |
| 2,745,386 | 5/1956 | Wildeman | 91/317 |
| 2,992,636 | 7/1961 | Sampietro | 91/323 |
| 3,267,816 | 8/1966 | Graham | 91/178 |
| 3,267,817 | 8/1966 | Adams | 91/186 |
| 3,425,498 | 2/1969 | Bick | 91/317 |
| 3,440,967 | 4/1969 | Pennther | 91/317 |
| 3,516,763 | 6/1970 | Manton | 91/318 |
| 3,780,622 | 12/1974 | Vogel | 91/317 |
| 3,973,445 | 8/1976 | Ballard | 74/89.21 |
| 4,225,110 | 9/1980 | Akkerman et al. | 251/58 |
| 4,425,835 | 1/1984 | Krasnoff | 91/317 |

*Primary Examiner*—Abraham Hershkovitz
*Attorney, Agent, or Firm*—Gausewitz, Carr & Rothenberg

[57] ABSTRACT

This invention provides a valving arrangement for a reciprocating engine in which there are two valve assemblies, each with a pressure responsive valve member. As the piston approaches the end of its stroke in either direction, the exhaust port is closed, such as by an extension on the piston, causing fluid pressure to build up in the end of the cylinder. This pressure is conducted to the valve assemblies through fluid lines, causing the pressure-responsive valve members to move in response to the pressure build-up in the end of the cylinder. These valve members control the inlet and exhaust connections to the cylinder so that the piston is caused to reciprocate by the working fluid as the valve members are moved pneumatically to open and close the lines.

7 Claims, 5 Drawing Figures

ENGINE WITH PNEUMATIC VALVE ACTUATION

BACKGROUND OF THE INVENTION

This invention relates to a valving arrangement, particularly adapted for an engine having a free-floating piston. Engines of this type offer numerous advantages, including unlimited bore to stroke ratio, the absence of side loading between the piston and the cylinder, and the elimination of heavy parts in the drive train. However, in such engines, smooth, uniform reciprocation is not inherent in the mechanical configuration. The motion of the free piston is governed only by the force of the working fluid and the resistance of the work being done. Therefore, valving is critical to assure that the working fluid will move the piston back and forth efficiently.

In accordance with this invention, the valve movement occurs as a result of the movement of the piston, automatically actuating the valves pneumatically as the piston approaches the end of its stroke. In one embodiment, the cylinder is constructed so as to have a chamber of reduced diameter at either end, forming extensions of the cylinder. Plungers project from the piston and are dimensioned to complementarily enter the chambers. The exhaust ports are within these chambers. Therefore, when a plunger of the piston enters one of the chambers, it cuts off the exhaust, trapping gas within the cylinder on the forward side of the piston. There is also a small fluid line connecting to either end of the cylinder. These two lines go to opposite ends of two valve assemblies. Within these assemblies are reciprocative floating valve members. As the piston approaches the end of its stroke, the pressure of the captured gas in the end of the cylinder is sensed in the small fluid lines, causing the valve members to move. In this way, the valve members are moved so as to appropriately open and close the inlet and exhaust to the cylinder so that the actuating fluid can force the piston back and forth through its stroke.

DETAILED DESCRIPTION OF THE INVENTION

Figure 1:
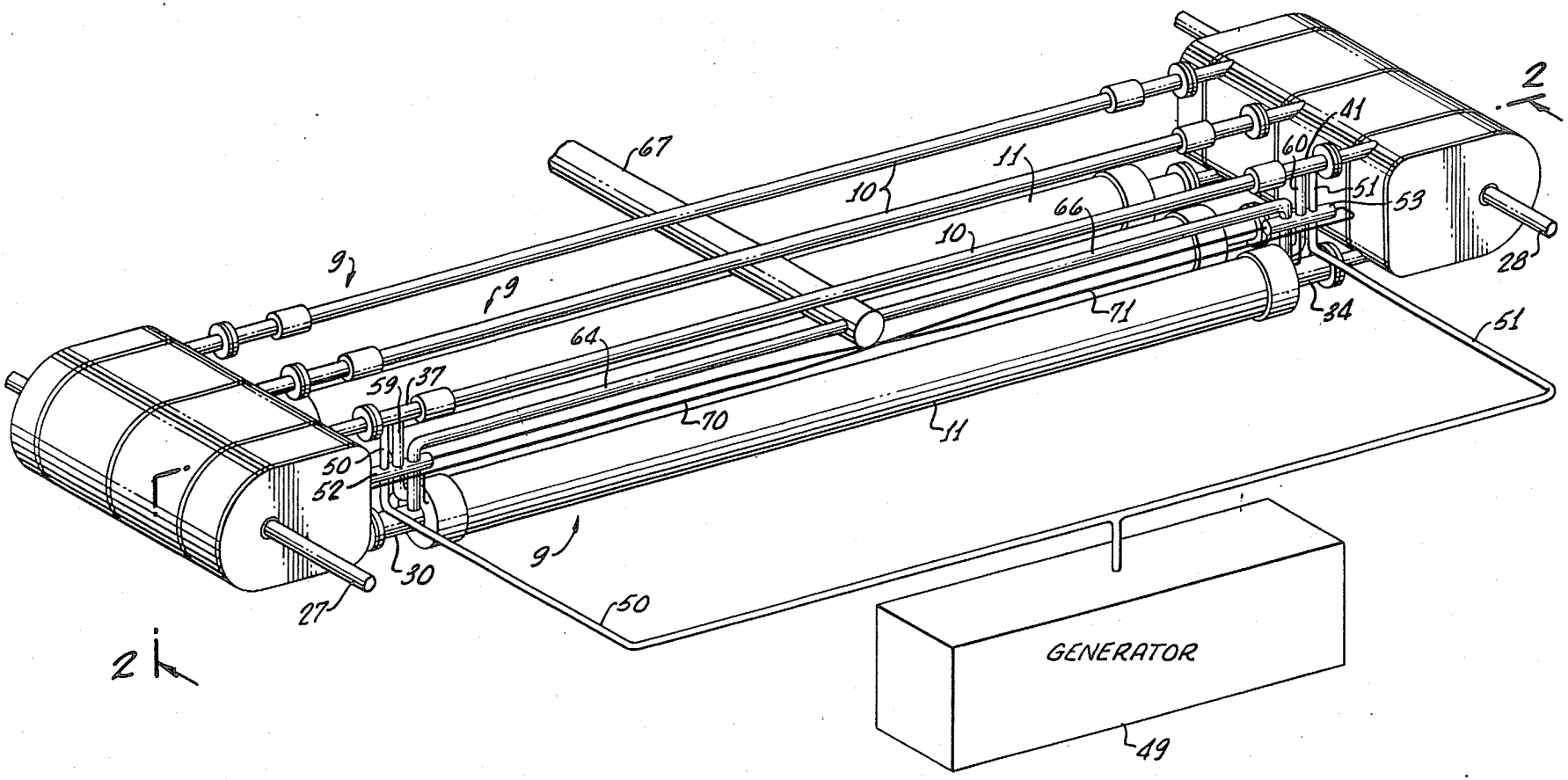
FIG. 1 is a perspective view of an assembly of engines of this invention.

Illustrated in FIG. 1 is an assembly of three compound engines 9 each including a relatively small diameter primary cylinder 10, beneath which is a larger diameter secondary cylinder 11. In a typical example, for an engine with an eight-foot stroke, the cylinder 10 may be two inches in diameter and the cylinder 11 eight inches in diameter. Within the cylinder 10 of each engine is a piston 12, having spaced spools 13 and 14 for stability. The piston 15 in the larger cylinder 11 is similarly constructed, with spools 16 and 17.

The pistons 12 and 15 of each engine are free-floating, with driven elements 19 being connected to their ends.

Figure 2:
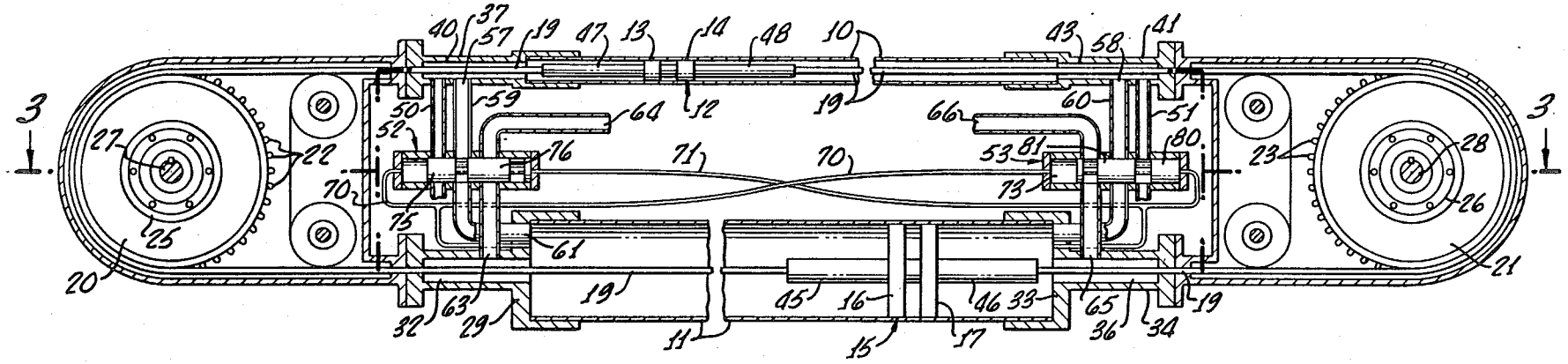
FIG. 2 is an enlarged fragmentary sectional view taken along line 2—2 of FIG. 1.
Figure 3:
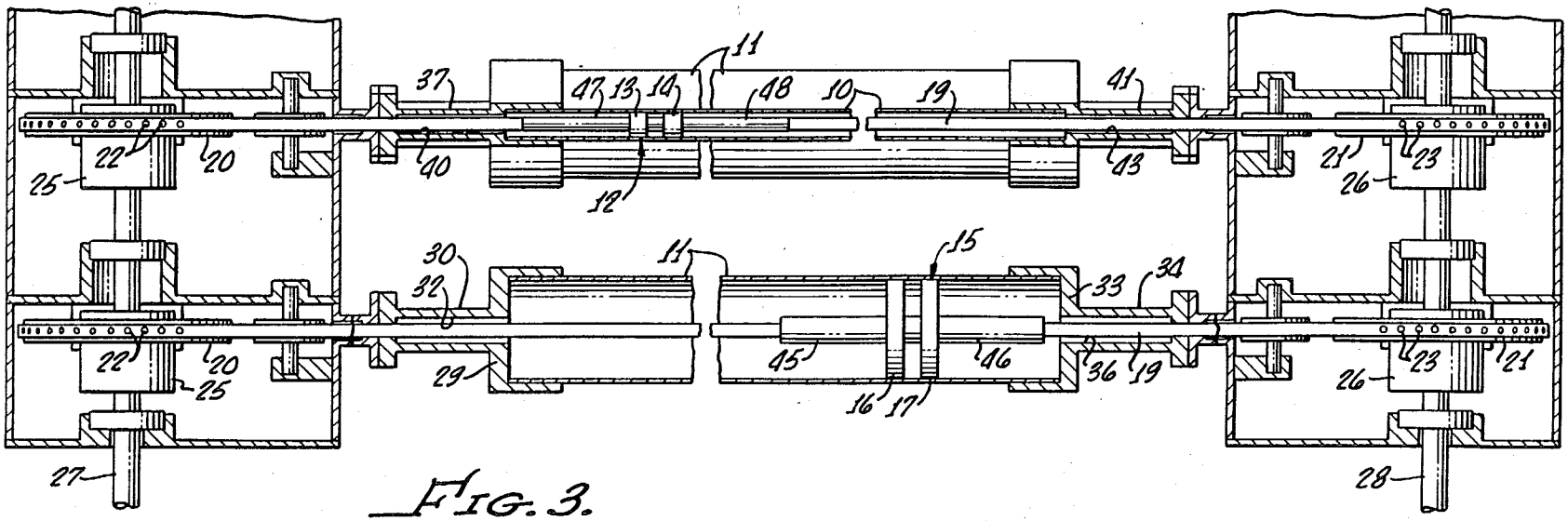
FIG. 3 is a sectional view taken along line 3—3 of FIG. 2.

These may be flexible straps that extend from the cylinders 10 and 11 to pulleys 20 and 21 which they wrap around and return to the cylinders. In other words, the strap 19 of each engine 9 leaves the cylinder 10 at one end, to the left as illustrated in FIG. 2, extending around the pulley 20 and reversing direction to enter the cylinder 11 for connection to the piston 15. Similarly, at the right-hand end of the assembly, as shown, the strap 19 extends from the piston 15 in the cylinder 11 around the pulley 21 for 180°, and from there back into the cylinder 10 to connect to the piston 12. The straps 19 may be perforated at the portions that extend around the pulleys 20 and 21 to accommodate lugs 22 and 23 extending from these pulleys. This is to provide a positive drive between the straps 19 and the pulleys. Suitable seals, not shown, are provided where the straps 19 enter the cylinders.

The pulleys 20 and 21 rotate overrunning clutches 25 and 26, respectively, which, in turn, drive output shafts 27 and 28. As a result, although the pulleys 20 and 21 oscillate as the pistons 12 and 15 move back and forth, the output shafts 27 and 28 are turned in only one direction.

The engine is actuated entirely by tension in the straps 19, as one piston pulls the strap around the pulley 20 at the same time that the other piston pulls the strap around the pulley 21. When the pistons reverse their directions, the opposite actuation of the pulleys occurs.

The cylinder heads for the cylinders 10 and 11 include axial extensions defining cylindrical chambers at the ends of the cylinders. Thus, the head 29 at the left-hand end of the larger cylinder 11, as the engine is illustrated, has a cylindrical extension 30 that is smaller in diameter than is the cylinder 11. The extension 30 terminates at an end wall 31 which closes the outer end of the cylindrical chamber 32 which the extension forms. Similarly, the head 33 at the right-hand end of the cylinder 11 has an axial extension 34, equal in diameter and length to the extension 30, with an outer end wall 35. The result is a cylindrical chamber 36, closed at one end.

The heads for the smaller cylinder 10 are constructed in the same manner. At the left-hand end, as illustrated, an axial extension 37 projects from the head 38 and is closed at its outer end by a wall 39. This produces a cylindrical chamber 40. At the right-hand end, the axial extension 41 of the head 42 is of the same diameter and length as the extension 37 at the opposite end. The chamber 43 formed by the extension 41 terminates at an outer end wall 44. The chambers 40 and 43 are of smaller diameter than the chambers 32 and 36 of the cylinder 11. However, their lengths are the same. The straps 19 pass through the end walls 31, 35, 39 and 44.

The pistons have axial extensions, or plungers, which are adapted to enter the cylindrical chambers at the cylinder heads at the ends of the cylinders. This includes plungers 45 and 46 at the opposite ends of the larger piston 15, which are of the same lengths as the cylindrical chambers 32 and 36, to which they are complementary on their cylindrical peripheries. Plungers 47 and 48 on the opposite ends of the smaller piston 12 are of the same length as the chambers 40 and 43, and dimensioned on their peripheries to complementarily fit within these chambers.

Gas from a generator 49, such as a boiler, is supplied to the engine through inlet lines 50 and 51 which pass through valve assemblies 52 and 53 to connect to ports 54 and 55 in the cylindrical extensions 37 and 41 of the cylinder heads 38 and 42 of the smaller cylinder 10. These ports are adjacent the end walls 39 and 44. Therefore, gas from the inlet line 50 can drive the piston 12 to the right, as illustrated, and gas from the line 51 will drive this piston to the left.

Exhaust for the cylinder 10 is through ports 57 and 58 and lines 59 and 60 that pass through the valve assemblies 52 and 53 to ports 61 and 62 in the outer cylinder heads 29 and 33, respectively, of the larger cylinder 11. Therefore, extensions of the exhaust lines of the primary cylinder 10 are the inlet lines of the secondary cylinder 11. Gas from the primary cylinder 10 can expand as exhaust from that cylinder into the secondary cylinder 11 through the lines 59 and 60 to drive the piston 15 to the right and to the left as these lines are opened and closed.

An exhaust port 63 in the cylindrical extension 30 of the head 29 at the left-hand end of the larger cylinder 11, connects to a line 64 that leads to the valve assembly 52, and from there to the ultimate exhaust from the engine. The port 63 is adjacent the head 29 and spaced from the end wall 31.

The right-hand end of the engine, as illustrated, is the same, with a port 65 in the cylindrical extension 34 connecting to a line 66 that leads to the valve assembly 53. The port 65 is located close to the cylinder head sections 33 and spaced some distance from the outer end wall 35.

The exhaust lines 64 and 66, downstream of the valve assemblies 52 and 53, connect to an exhaust manifold 67 which, in a steam engine, may lead to a condenser.

Small ports 68 and 69 in the cylinder heads 29 and 33, respectively, of the larger cylinder 11, connect to fluid lines 70 and 71. The line 70 from the port 68 splits, with one part being connected to the left-hand end of the cylindrical chamber 72 of the valve assembly 52. The other section of the line 70 connects to the left-hand end of the cylindrical chamber 73 of the valve assembly 53.

The line 71 from the port 69 in the cylinder head 33 also splits, connecting to the right-hand end of the cylindrical valve chamber 72 of the valve assembly 52, and the right-hand end of the valve chamber 73 of the valve assembly 53.

Within each of the valve chambers is a free floating valve member. In the valve chamber 72 of the valve assembly 52 the valve member 74 has three spaced spools 75, 76 and 77. The spool 76 is the longest and is located between the other two spools of the valve member 74. The spool 77 is relatively short and is adjacent the line 71.

The valve member 79 in the valve chamber 73 is identical to the valve member 74, being provided with spaced spools 80, 81 and 82. The short spool 82 is at the left-hand end of the valve member 79, as the device is illustrated, just as the narrow spool 77 is at the right-hand end of the valve member 74.

Figure 4:
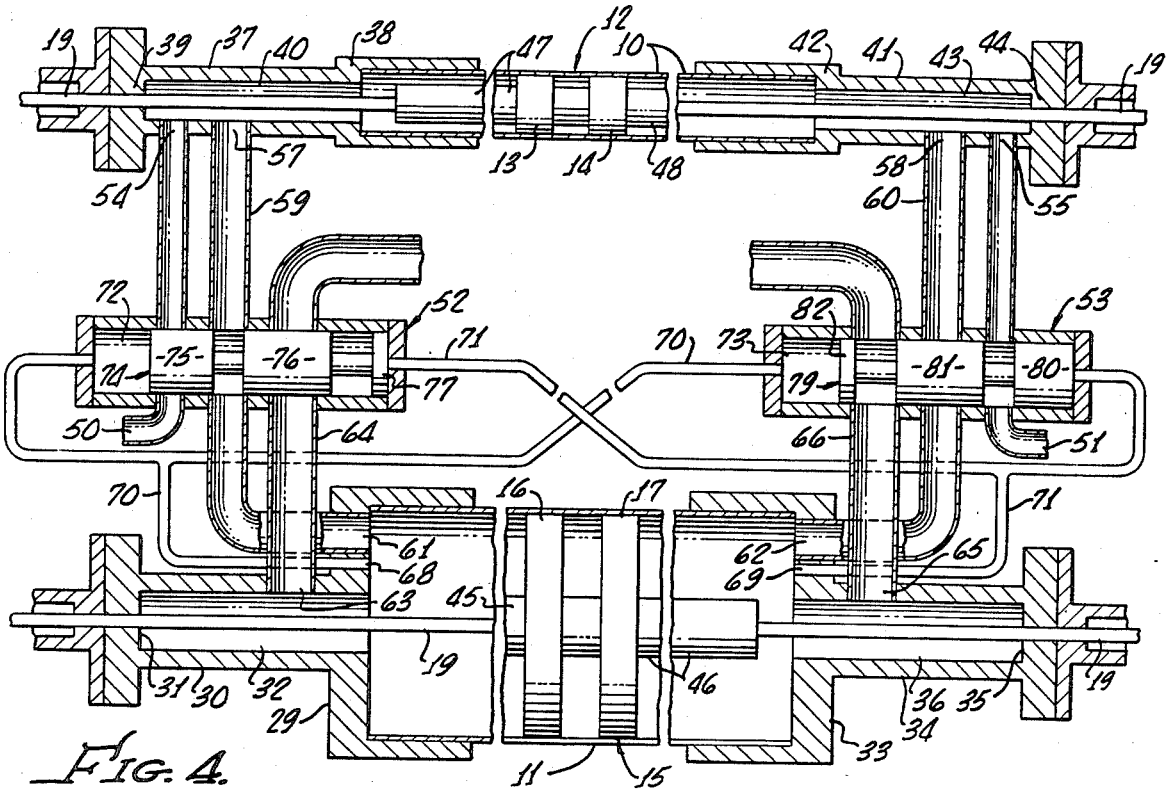
FIG. 4 is a further enlarged fragmentary longitudinal sectional view of the engine with the valves in one position.

As the engine is illustrated in FIG. 4, valve member 79 of the valve assembly 53 is positioned at the right-hand end of the valve chamber 73. All of the fluid line connections to the valve units 52 and 53, with the exception of the pressure lines 70 and 71, are to the sides of valve chambers 72 and 73. These connections are such that in the position of FIG. 4, the connection of the line 51 from the gas generator 49 is between the spools 80 and 81 so that gas can flow through the line 51 and the port 55, into the smaller cylinder 10 at the chamber 43. This drives the piston 12 toward the opposite end of the cylinder 10, or to the left as illustrated. The spool 81 of the valve member 79 covers the exhaust line 60 so that the gas from the line 51 must be used to drive the piston 12 and cannot escape through the valve into cylinder 11 through the line 60. This position of the valve member 79 also locates the exhaust line 66 between the spools 81 and 82. Therefore, gas can be exhausted from the larger cylinder 11 beyond the right-hand end of the piston 15.

In the valve assembly 52, in the position of FIG. 4, the valve member 74 is positioned at the right-hand end of the chamber 72, uncovering the connection to the line 59 which is between the spools 75 and 76. Therefore, as the piston 12 is driven to the left, as illustrated, the exhaust gas ahead of this piston can flow outwardly through the port 57 and line 59, through the valve 52 and the port 61, into the larger cylinder 11. This gas reacts against the left-hand end of the piston 15, driving this piston toward the right-hand end of the cylinder 11.

With the valve member 74 at the right-hand end of the valve chamber 72, the gas inlet line 50 is closed by the spool 75 so that gas from the generator will not enter the cylinder 10 through the line 50. Also, the spool 76 closes the exhaust line 65 so that the expansion gas entering the cylinder 11 through the port 61 cannot flow outwardly through the port 63, but must instead drive the piston 15.

Figure 5:
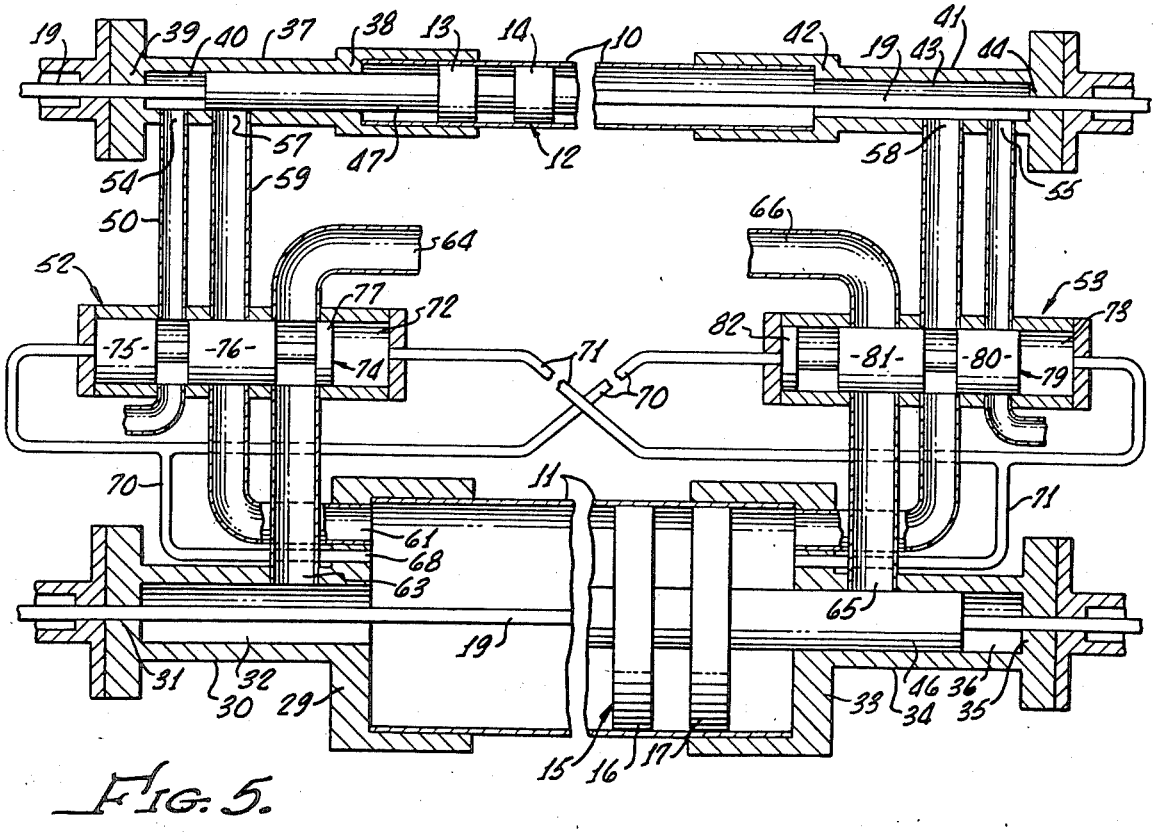
FIG. 5 is a view similar to FIG. 4 but with the valves in their other position.

When the piston 15 approaches the right-hand end of the cylinder 11, its plunger 46 will enter the cylindrical chamber 36. As it does so, it closes the port 65 so that the cylinder 11 no longer is connected to exhaust. Therefore, some exhaust gas is trapped inside the cylinder 11 on the right-hand end of the piston 15, both within the chamber 36 and outside of this chamber on the forward end of the piston 15. This gas acts as a pneumatic spring, helping to slow the piston down as it approaches the end of its stroke. The entrapped gas also builds up pressure in the fluid passage 71 through its connection to the port 69 in the cylinder head 33. This creates pressure in the valve chamber 72 of the valve 52 on the right-hand end of the valve member 74. It also exerts pressure in the valve chamber 73 of the valve 53 on the right-hand end of the valve member 79. As the piston 15 approaches the cylinder head 33, this pressure becomes sufficient to move the valve members 74 and 79 to the opposite ends of the chambers 72 and 73, respectively. This position may be seen in FIG. 5. When that occurs, the gas inlet line 51 is blocked by the spool 80, cutting off the supply of pressurized gas to the right-hand end of the small piston 12. At the same time, the line 50 is opened, being between the spools 75 and 76 so that gas may enter the cylinder 10 at the left-hand end of the piston 12 to reverse its direction and drive it back to the opposite end of its stroke. This valve position opens the exhaust line 60 so that the exhaust from the cylinder 10, as the piston 12 moves to the right, flows into the right-hand end of the cylinder 11 to drive the piston 15 to the left. The exhaust line 64 is opened as it is now between the spools 76 and 77 of the valve member 74. Of course, when the piston 15 approaches the cylinder head 29 and its plunger 45 enters the chamber 32, a quantity of gas is trapped at that end of the cylinder as the plunger 46 closes the port 63. This increases the pressure in the fluid passage 70 to again move the valve members 74 and 79, returning them to the position of FIG. 4.

Therefore, the engine can reciprocate as the pressure-responsive valve members are actuated by the gas of the engine, automatically shifting their positions as the pistons approach the ends of their strokes. This operation is entirely pneumatic, requiring no separate valve mechanism. The longer spools 76 and 81 of the valve members 74 and 79 control the inlet and exhaust to the larger cylinder 11, as well as the exhaust of the smaller cylinder 10. The spools 75 and 80 of intermediate length control only the inlet to the smaller cylinder 10. The short spools 77 and 82 act as pistons, responding to pressure in the lines 70 and 71 to reciprocate the valve members.

All of the valve actuation is achieved by gas from the larger expansion cylinder 11. Therefore, the plunger extensions 47 and 48 of the smaller piston 12 do not function as do the plungers 45 and 46 in actuating the valves. The plungers 47 and 48 are included only to distribute the load on the drive train more evenly while the momentum of the drive train is reversing, as well as acting as pneumatic springs to facilitate reversal of the movement of the piston 12.

Pneumatic valve operation also may be accomplished in a single expansion engine of one cylinder, in which event the spools 75 and 80 would not control inlet lines. It is possible, also, to provide only a single valve assembly for pneumatic valve operation at one end of the cylinder and not the other.

Although the plunger extensions and chambers in the cylinder heads to receive them are preferred, it is possible, also, to position the exhaust ports in the cylinder wall to be closed as the piston passes to build up pressure in the valve-actuating lines.

The foregoing detailed description is to be clearly understood as given by way of illustration and example only, the spirit and scope of this invention being limited solely by the appended claims.

What is claimed is:

1. An engine comprising a cylinder a floating piston in said cylinder, a first inlet port and a first exhaust port adjacent one end of said cylinder, a second inlet port and a second exhaust port adjacent the opposite end of said cylinder, a first inlet line connected to said first inlet port, a second inlet line connected to said second inlet port, a first exhaust line connected to said first exhaust port, a second exhaust line connected to said second exhaust port, a first valve unit connected to said first inlet line and said first exhaust line, a second valve unit connected to said second inlet line and said second exhaust line, a first pressure responsive valve member in said first valve unit movable to two positions in one of which it opens said first inlet line and closes said first exhaust line, and in the other of which it closes said first inlet line and opens said first exhaust line, a second pressure responsive valve member in said second valve unit movable to two positions in one of which it opens said second exhaust line and closes said second inlet line, and in the other of which it closes said second exhaust line and opens said second inlet line, a first fluid passage extending from said one end of said cylinder to said first and second valve units and connected such that fluid pressure in said first fluid passage will urge said first pressure responsive valve member to said one position thereof, and said second valve member to said one position thereof, a second fluid passage extending from the opposite end of said cylinder to said first and second valve units, and connected such that fluid pressure in said second fluid passage will urge said first valve member to said other position thereof and will urge said second valve member to said other position thereof, means for closing said second exhaust port as said piston approaches said opposite end of said cylinder for building up pressure in said second fluid passage for moving said first and second pressure responsive valve members to said other positions thereof, and means for closing said first exhaust port as said piston approaches said one end of said cylinder for building up pressure in said first fluid passage for moving said first and second pressure responsive valve members to said one position of each of said valve members.

2. A device as recited in claim 1 in which said cylinder includes a first relatively small chamber at said one end thereof and a second relatively small chamber at said opposite end thereof, said first exhaust port being in said first chamber inwardly of the outer end thereof, said second exhaust port being in said second chamber inwardly of the outer end thereof, said piston including a first extension on one end remote from said first chamber except that said first extension is dimensioned to complementarily enter said first chamber as said piston approaches one end of its stroke for thereby closing off said first exhaust port for building up pressure in said first fluid passage, said piston including a second extension remote from said second chamber except that said second extension is dimensioned to complementarily enter said second chamber as said piston approaches the opposite end of its stroke for closing off said second exhaust port for building up pressure in said second fluid passage.

3. A device as recited in claim 2 in which said first and second chambers are cylindrical and axially aligned with said cylinders, and said first and second extensions have cylindrical exterior surfaces and are axially aligned with said piston.

4. A device as recited in claim 1 in which said first valve unit includes a first cylindrical valve chamber, said first inlet line and said first exhaust line connecting to side portions of said first valve chamber, said first and second fluid passages connecting to opposite ends of said first valve chamber, said first pressure responsive valve member including at least one valve spool movable axially of said first valve chamber to said two positions thereof, and said second valve unit includes a second cylindrical valve chamber, said second inlet line and said second exhaust line connecting to side portions of said second valve chamber, said first and second fluid passages connecting to opposite ends of said second cylindrical valve chamber, said second pressure responsive valve member including at least one valve spool movable axially of said second valve chamber to said two positions thereof.

5. A device as recited in claim 1 including in addition a second cylinder, a second floating piston in said second cylinder, a third inlet port and a third exhaust port adjacent one end of said second cylinder, a fourth inlet port and a fourth exhaust port adjacent the opposite end of said second cylinder, a third inlet line connected to said third inlet port, a fourth inlet line connected to said fourth inlet port, a third exhaust line connected to said third exhaust port, and a fourth exhaust line connected to said fourth exhaust port, said third inlet line and said third exhaust line being connected to said first valve unit, said fourth inlet line and said fourth exhaust line being connection to said second valve unit, said first inlet line forming an extension of said third exhaust line, and said second inlet line forming an extension of said fourth exhaust line, such that when said first pressure responsive valve member is in said one position thereof it opens said third exhaust line and closes said third inlet line, and in said other position thereof it closes said third exhaust line and opens said third inlet line, and when said second pressure responsive valve member is in said one position thereof it closes said fourth exhaust line and opens said fourth inlet line, and in said other position thereof it opens said fourth exhaust line and closes said fourth inlet line.

6. A device as recited in claim 5 in which each of said presure responsive valve members includes at least two valve spools, one of said spools of said first pressure responsive valve member controlling said first exhaust line, said first inlet line and said third exhaust line, the other of said spools thereof controlling said third inlet line, one of said spools of said second pressure responsive valve member controlling said second exhaust line, said second inlet line and said fourth exhaust line, the other of said spools of said second pressure responsive member controlling said fourth inlet line.

7. A device as recited in claim 5 including a first pulley means, a second pulley means, a first tension member connected to said first mentioned floating piston and to said second floating piston, said first tension member extending outwardly through an end of each of said first mentioned cylinder and said second cylinder, and around said first pulley means for oscillating the same, a second tension member connected to said first mentioned floating piston and to said second floating piston, said second tension member extending outwardly through opposite ends of said first mentioned cylinder and said second cylinder, and around said second pulley means for oscillating the same, a first output shaft, a second output shaft, a first overrunning clutch means connecting said first pulley means to said first output shaft for causing rotation of said first output shaft in one direction upon oscillation of said first pulley means by said first tension member, and a second overrunning clutch means connecting said second pulley means to said second output shaft for causing rotation of said second output shaft in one direction upon oscillation of said second pulley means.

* * * * *